United States Patent [19]

Kröll et al.

[11] Patent Number: 5,005,714

[45] Date of Patent: Apr. 9, 1991

[54] CRANE, IN PARTICULAR A LARGE MOBILE CRANE

[76] Inventors: Joachim Kröll, Steinstrasse 1, 4053 Jüchen 1; Walter Köllner, Mendelssohnweg 25, 4052 Korschenbroich 2, both of Fed. Rep. of Germany

[21] Appl. No.: 384,138

[22] Filed: Jul. 21, 1989

[30] Foreign Application Priority Data

Jul. 21, 1988 [DE] Fed. Rep. of Germany ..... 3824732

[51] Int. Cl.[5] ..... B66C 23/76

[52] U.S. Cl. ..... 212/196; 212/178; 212/182; 212/232

[58] Field of Search ..... 212/195–197, 212/211, 223, 227, 231–239, 255, 260–263, 178, 182, 186, 156

[56] References Cited

U.S. PATENT DOCUMENTS

| | | | |
|---|---|---|---|
| 1,195,461 | 8/1916 | Greene | 212/195 |
| 4,166,542 | 9/1979 | Bryon, Jr. | 212/231 |
| 4,258,852 | 3/1981 | Juergens | 212/178 |
| 4,336,889 | 6/1982 | McGrew | 212/178 |
| 4,492,312 | 1/1985 | Poock | 212/231 |
| 4,557,390 | 12/1988 | Mick | 212/197 |
| 4,635,803 | 1/1987 | Foster et al. | 212/239 |
| 4,729,486 | 3/1988 | Petzold et al. | 212/189 |
| 4,826,023 | 2/1989 | Ortemond | 212/239 |

FOREIGN PATENT DOCUMENTS

| | | | |
|---|---|---|---|
| 1176812 | 8/1964 | Fed. Rep. of Germany | 212/195 |
| 2312191 | 9/1974 | Fed. Rep. of Germany | 212/195 |
| 1548415 | 10/1968 | France | 212/195 |

*Primary Examiner*—Joseph F. Peters, Jr.
*Assistant Examiner*—R. B. Johnson
*Attorney, Agent, or Firm*—Cohen, Pontani & Lieberman

[57] ABSTRACT

A crane, particularly a large mobile crane, including an undercarriage (1); a revolving joint (3) on the undercarriage (1); and a superstructure on the revolving joint (3). The superstructure includes a central part (5) rotatably mounted on the revolving part (3), a boom connected to the central part (5), a swing part (6), and a horizontal swing bearing (9) pivotally mounting the swing part in upwardly swingable manner on the central part (5). The crane further includes at least one winch mounted on the swing part (6) and a retraction mechanism at the end of the swing part (6) opposite the swing bearing (9). The retraction mechanism includes a pulley head (16) and a bracing (25) for the boom.

1 Claim, 12 Drawing Sheets

CRANE, IN PARTICULAR A LARGE MOBILE CRANE

FIELD OF THE INVENTION

The present invention relates to a crane, particularly a large mobile crane, having an undercarriage bearing a superstructure which, via a revolving joint, supports at least one boom, particularly a lattice boom.

BACKGROUND OF THE INVENTION

Cranes of the above type include essentially an undercarriage—frequently developed for travel—a superstructure rotatable thereon around a vertical axis, as well as at least one boom which is swingable in the vertical plane and on the upper end of which further booms can be pivoted. For the raising—as well as the lowering—of the main boom various devices are known and furthermore necessary, as can be noted, for instance, from Federal Republic of Germany Patent 29 33 382. While the measures disclosed in that patent cover the requirements as to the stability of the crane upon use and its supporting capacity, these measures not only represent a considerable structural expense and thus also considerable weight for the machine also an expenditure of time upon the setting up and removal of the apparatus, which reduces the use-time.

In addition, under the law governing mobile cranes on highways the permissible axle loads are subject to an upper limit. These provisions lead, particularly in the case of large mobile cranes, to a large number of axles, so that 10-axle machines are no rarity. This also means expensive constructions of the undercarriage, in which connection extremely powerful drive units are necessary for the transporting of the entire vehicle. This drive must be transmitted via an expensive longitudinal differential to a plurality of axles which are at a great distance from each other. Due to its high power, the drive of the undercarriage cannot be readily used also for the operation of the crane, so that an additional drive unit with the customary peripheries for the crane is provided in the superstructure. To this end, suggestions are made in Federal Republic of Germany OS 36 39 709 for reducing the cost of manufacture.

None of these previously known proposals, however, has been able in any way to change the fact that the requirement of the highest possible supporting capacities could be satisfied only at a correspondingly high structural expense—with the result of considerably greater weights—and with the disadvantage of costly setup times.

SUMMARY OF THE PRESENT INVENTION

An object of this invention is to provide a crane of the above-mentioned type which, with at least equal supporting capacity and with simultaneous reduction in travel weight and reduction of the setup times as compared with comparable machines, can be produced at lower cost and nevertheless exhibits greater adaptability, in particular, diversity of use.

The solution provided by the present invention, differing from previous proposals, is based on the idea of solving the prior art problems primarily not by structural measures on the undercarriage but by a fundamentally different design of the superstructure, and provides that at least a part of the superstructure or the longitudinal axis thereof is adjustable with respect to the angle thereof relative to the longitudinal axis of the undercarriage In this connection it is provided, in particular, that the superstructure is divided at least in two parts and that the part facing away from the main boom (hereinafter referred to as the "swing part") is swingable in a vertical plane relative to the part connected to the revolving joint (hereinafter referred to as the "central part").

This design surprisingly results in considerable simplification and, accordingly, in various embodiments which will be discussed below and which include, in particular, the elimination of the mounting supports otherwise necessary, with the surprising possibility of utilizing its structural height for the structural height of the supporting structure (superstructure according to the invention) or of permitting other structural parts to benefit from the advantage as to space gained by the design in accordance with the invention, for instance the undercarriage, whereby, in turn, higher loads are possible than in the case of comparably large machines. The gain in structural height achieved by the present invention, i.e. the comparatively lower structural height, can naturally also be advantageously utilized, for instance, for increased maneuverability and use in areas covered by roofs or similar structures. Furthermore, particularly the elimination of the mounting supports, results in a reduction in cost as well as a reduction in travel weight so that, instead of a 10-axle undercarriage which would otherwise be necessary, now at most eight axles are necessary for the same capacity.

In particular in the case of cranes which are provided with lattice booms, the invention is extremely advantageous since the mounting for the raising of the crane is considerably simplified since it is now possible, due to the lower weight of the superstructure, to have a longer boom with equally large supporting capacity of the undercarriage.

The novel design of the superstructure in accordance with the present invention still renders possible for the central part to have or bear an operator's cab on the side facing away from the swing part, preferably in the region of the lower end of the main boom, so that the operating personnel need not be newly trained.

Based on the concept of the present invention results a surprisingly large number of embodiments of the superstructure which can be adapted to different uses, all having the advantages indicated above and furthermore leading to additional simplification or optimization. Of these embodiments, there is first of all mentioned a particularly rational and structurally inexpensive embodiment in which the center part is developed as a plate which rests flat on the revolving joint and is connected thereto and over which plate the swing part extends at least in part. In this connection, the dimensions of the plate can correspond approximately to those of the revolving joint. In this way, with the same length of vehicle the swing part can be correspondingly longer and thus more effective in its manner of action and reach.

If, as in the preferred embodiment, the swing part bears cable winches and is equipped with a masthead with pulleys for a retraction mechanism, the particular advantage of the invention becomes evident since, as a result, the superstructure can be used not only for the supporting winches and the counterweight, as already in the case of known machines, but now also as mounting support with a set of pulleys and as a counterboom, with simultaneous saving of a second main-boom lower end. As a further advantage, the ram(s) which swing the superstructure or part thereof with respect to the horizontal, serve simultaneously to receive the counterweight plates, whereby the swingable superstructure may be considered as the quasi-boom of an auxiliary crane which, in the case of comparable machines, is used in addition for the setup work and is absent at least during this setup time in the case of other work, as a result of which setup times can also be saved hereby and the goal of travelling at night with complete utilization during the day which is desired for such large machines can be realized.

The free end of the swing part is preferably equipped with means for receiving a counterweight which comprises a hydraulic ram with means for attachment at its free end. This hydraulic ram enables the vertical displacement of the counterweight.

Another advantageous adaptation of the effect of the counterweight to the use of the crane at a particular time can be obtained if, in accordance with a further advantageous embodiment, there is pivoted on the central part at least one hydraulic ram which in operating position—preferably arranged substantially horizontally—acts with its free end on the counterweight. This enables an infinitely variable change in the counterweight lever arm.

For the connection between the central part and the swing part of the superstructure, the invention provides a swing joint, preferably a swing ram between the central part and the swing part which are connected via at least one swing bearing having preferably a horizontal axis extending perpendicular to the longitudinal axis of the superstructure. This basic concept of the swing joint between swing part and central part opens up a large number of advantageous solutions for the structural development of the connection therebetween. Thus the swing bearing can be located at the height of the revolving joint, and preferably on the side of the central part facing away from the operator's cab. This in this case, the swing ram should be pivoted to the central part in the region of the upper edge of said part. If, in a further development, the swing bearing is arranged on the side of the central part which faces the operator's cab, then a particularly simple but effective embodiment results in that the central part can be developed as a simple plate which lies flat on the revolving joint and is connected to it, whereby both the swing bearing and the pivot point of the swing ram are located on the central part approximately at the height of the revolving joint. In addition, that end of the swing ram which is connected to the swing part is pointing towards the operator's cab end of the central part or of the plate and its other end is pivoted to that end of the central part or the plate facing away from the operator's cab, so that the swing part extends at least in part over the plate in space-saving manner.

On the other hand, however, for given purposes of use the swing bearing can also be located in the region of the upper edge of the central part, namely either on the side of the central part facing away from the operator's cab or else centrally above the revolving joint, which results in easily recognizable advantageous variants for the introduction of the forces, particularly the counter-forces, into the superstructure and thus optimal loadings of the revolving joint. In this version, the swing ram is preferably pivoted approximately at the height of the revolving joint to the central part on the side of the central part facing away from the operator's cab.

In all the above-mentioned embodiments, swing part can be braced as boom, so to speak, of an auxiliary crane, via the retraction mechanism, with the lower end of the main boom, the lower end of the boom possibly bearing a counterweight. Since the swing joint between the central part and the swing part is displaceable in infinitely variable manner in their angular position with respect to each other (floating), there is optimally possible, in cooperation with a further feature of the invention, namely the possibility of lengthening the swing part, a variable adaptation of the crane properties to local conditions, both with respect to obstacles such as buildings or other obstacles in space, as well as with respect to differences in load. Due to the fact that the superstructure is no longer used exclusively for receiving the counterweight, the superstructure of the invention can be utilized as main boom also for the normal operation of the crane, in which connection the main boom can remain in travel position, i.e. lying, and the bracing of the swing part then intended as boom for the crane operation may be attached to the lying main boom or the lower end thereof. This possibility of use affords particular advantages when working within buildings with only relatively low heights.

In order further to simplify the operation of the crane, the swing part, as a further embodiment of the invention, can be bolted in front of the front central part and therefore in the direction of view of the operator's cab. On the other hand, in this situation a heavy telescopic crane boom can also be mounted to the rear part so that lattice booms or telescopic booms can optionally be used without the need for several devices. In addition, the aforementioned advantage of elimination of a separate mounting support together with additional accessories with the consequential savings in weight, cost of manufacture and time applies to all of the aforementioned uses and structural embodiments.

In order to increase the supporting capacity, the present invention provides that the superstructure and, in particular, the swing part thereof be made so that the length thereof can be increased. This lengthening can be step-wise by the provision of one or more intermediate pieces, preferably of different length, after the unbolting of the set of pulleys between the pulley head and the cable-winch part of the swing part, or else continuously by rendering the swing part telescopically retractable and as extendable girder at least over a part of its length. Of course, a combination of step-wise and continuous lengthening is also within the scope of the present invention.

In yet another embodiment, the continuous and/or stepwise lengthening of the swing part is combined with a corresponding vertical lengthening of the counterweight receiver, for instance by hydraulic rams of corresponding length, equipped, if desired, with intermediate pieces, for the attachment of the counterweight.

Finally in accordance with the invention, the swing part may be divided so that the swing part is composed of a main girder and a bracing girder. This solution is particularly simple structurally if the bracing girder lies in its position of rest or travel flat on the main girder and extends substantially over the entire length of the main girder and the contour thereof preferably resembles that of the main girder. To this end, the bracing girder can be connected at one end in swingably moveable manner to the main girder close to its pulley head while its other end is mounted on the swing ram. This embodiment results in a particularly stable bracing without increasing the weight of the superstructure, i.e. without impairing the aforementioned advantages of the division of the superstructure in accordance with the invention into a central part and a swing part which are connected pivotally to each other and continuously adjustable in their angle with respect to longitudinal axes thereof.

BRIEF DESCRIPTION OF THE DRAWINGS

Further embodiments and advantages of the present invention will be described below in connection with the accompanying drawings in which.

DETAILED DESCRIPTION OF THE PRESENTLY PREFERRED EMBODIMENTS

In the following description the same reference numbers are used for identical or similarly acting structural parts, only the most important reference numbers being entered in FIGS. 3 to 17 for reasons of clarity of the drawings.

Figure 1:
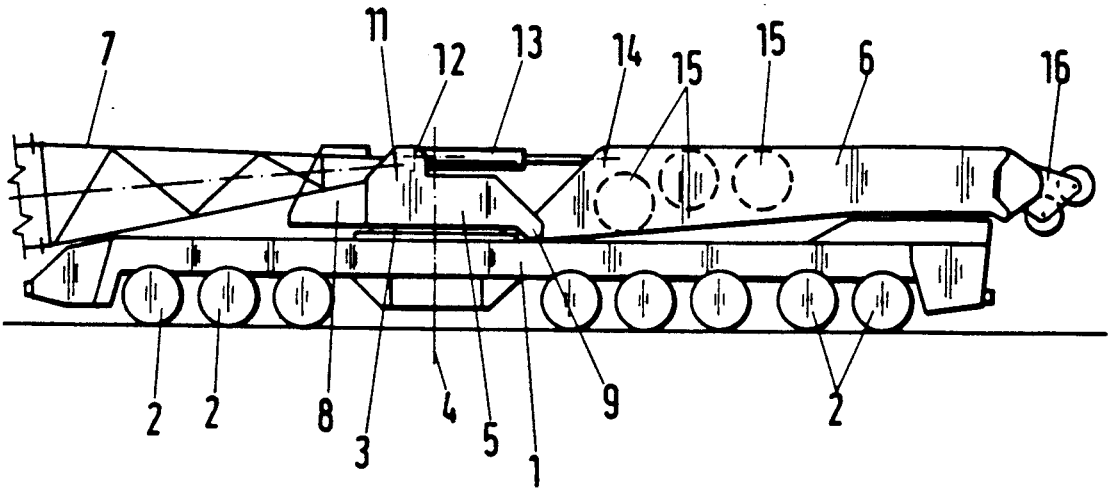
FIG. 1 shows a crane in transport position with a first embodiment of the superstructure in accordance with the invention.

The large crane shown in FIG. 1 comprises a crane undercarriage 1 with wheels 2, and a bipartite superstructure in accordance with the invention arranged thereon which can be swung via a roller revolving joint 3 around a vertical axis 4, the superstructure comprising a central part 5 and a swing part 6.

As can be noted from FIG. 1, an operator's cab 8 is located, as customary in traditional cranes of this type, on the superstructure in the direction of the lower end 7 of the main boom which is pivoted to it. On the side of the central part 5 of the superstructure which is opposite the operator's cab 8, the aforementioned swing part is bolted, namely in the embodiment shown here with a swing bearing 9 which is arranged approximately at the height of the revolving joint 3 and permits the swinging of the swing part 6 around a substantially horizontal axis. For this purpose, at the height of the upper edge of the central part 5 in the region between the pivot point 11 of the lower end 7 of the boom and the vertical axis 4, there is swingably fastened at a pivot point 12 a hydraulic cylinder or swing ram 13, the free piston end of which engages within the region of the upper edge of the swing part on a corresponding pivot point 14 in such a manner that in the transport situation shown in FIG. 1 the swing ram 13 assumes a substantially horizontal position.

Figure 2:
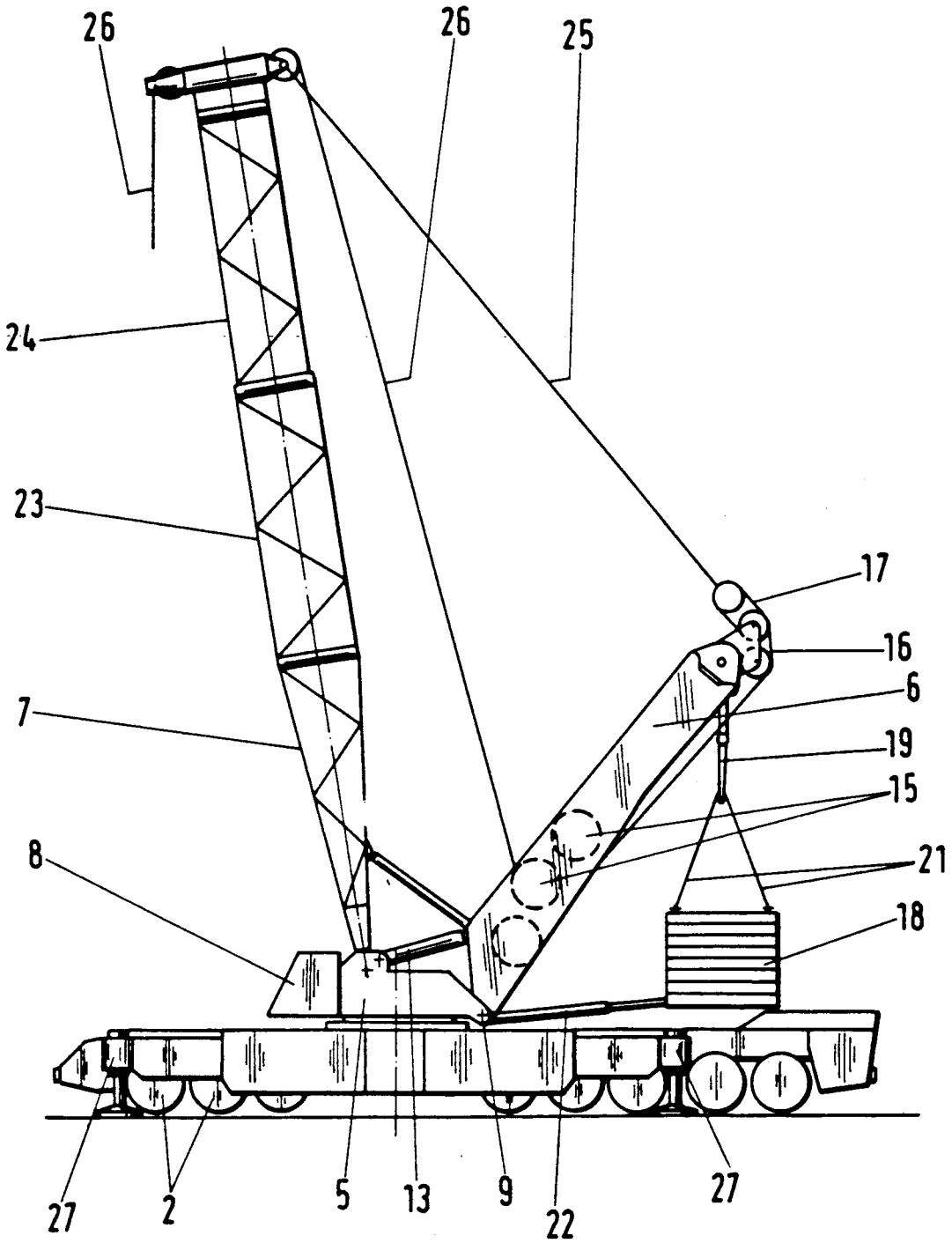
FIG. 2 shows the crane of FIG. 1 in operating position.

As can be furthermore noted from FIG. 1, the swing part 6 bears the cable winches 15 necessary for the crane and also, on its free end, a pulley head 16 with the pulleys of a retraction mechanism 17 shown in FIG. 2.

In FIG. 2 the crane of FIG. 1 is shown in operating position, which is reached essentially in the manner that swing ram 13 is actuated, i.e. retracted in the present case, so that the swing part 6 swings around the swing bearing 9 in a vertical plane and the longitudinal axes of the two superstructure parts thus extend now at an angle to each other in contradistinction to the transport position.

As can be furthermore seen from FIG. 2, a hydraulic cylinder or ram 19 is provided for the attachment of a counterweight 18 on the free end of the swing part 6, via which ram the counterweight 18 can be moved vertically up and down. The attachment of the individual plates of the counterweight 18 can be effected by corresponding cables 21. To stabilize the position of the suspended counterweight 18 there are provided preferably two additional hydraulic rams 22, the base points of which are pivoted in the region of the swing bearing 9 while their free ram end is attached to each side of the lower end of the counterweight 18. These hydraulic cylinders or rams 22, however, not only stabilize the counterweight but in simple and very advantageous manner also permit a horizontal change of position of the counterweight 18, thus enabling a very sensitive positioning of the counterweight which is variably adaptable in every respect as a function of the desired load-supporting capacity and reach, since both height and lever arm of the counterweight 18 can be adjusted optimally and rapidly.

FIG. 2 furthermore shows the lattice boom in steep or oblique position with additional sections 23 and 24 bolted onto the lower end of the boom, the rear bracing 25 of the retraction mechanism 17 taking place at the head of the main boom over which, furthermore, the load cable 26 to be actuated by the cable-winch 15 passes.

Finally, FIG. 2 also shows that in the case of heavy work in the operating position, support-feet 27 which can be hydraulically extended laterally and vertically thereby relieving the wheels and assuring dependable and broad support on the ground.

For the description of the further embodiments, the details already described above in connection with the description of FIGS. 1 and 2 can be dispensed with insofar as they apply also to the following examples, so that the description will in each case concern itself with the essential differences of the various embodiments.

FIGS. 3 to 6 show various modifications and embodiments for changing the length of the swing part 6. As in the case of the previously explained embodiment, the swing bearing 9 is located laterally to the bottom right on the superstructure central part 5 while, also in accordance with the embodiment previously described, the hydraulic cylinder or swing ram 13 has its pivot points in the upper region of the central part 5 and upper edge of the swing part 6. Furthermore in this embodiment also, in the same way as in the example in accordance with FIGS. 1 and 2, a continuous adjustability of the position of swing of the swing part 6 is enabled by suitably adapted extension and retraction of the swing ram 13. Of course, several swing rams can also be arranged in parallel and then be developed in corresponding manner with a smaller diameter, in which case the end position is determined in blocked position. Intermediate rings which can be placed on the ram rod enable variable angular positions of the superstructure swing part, the central part and swing part being mechanically locked for the standard load-supporting capacity by means of the swing ram or rams 13. In the operating position for increased supporting capacity, locking is not effected, so that the swing ram or rams 13 are then in floating position.

Figure 3:
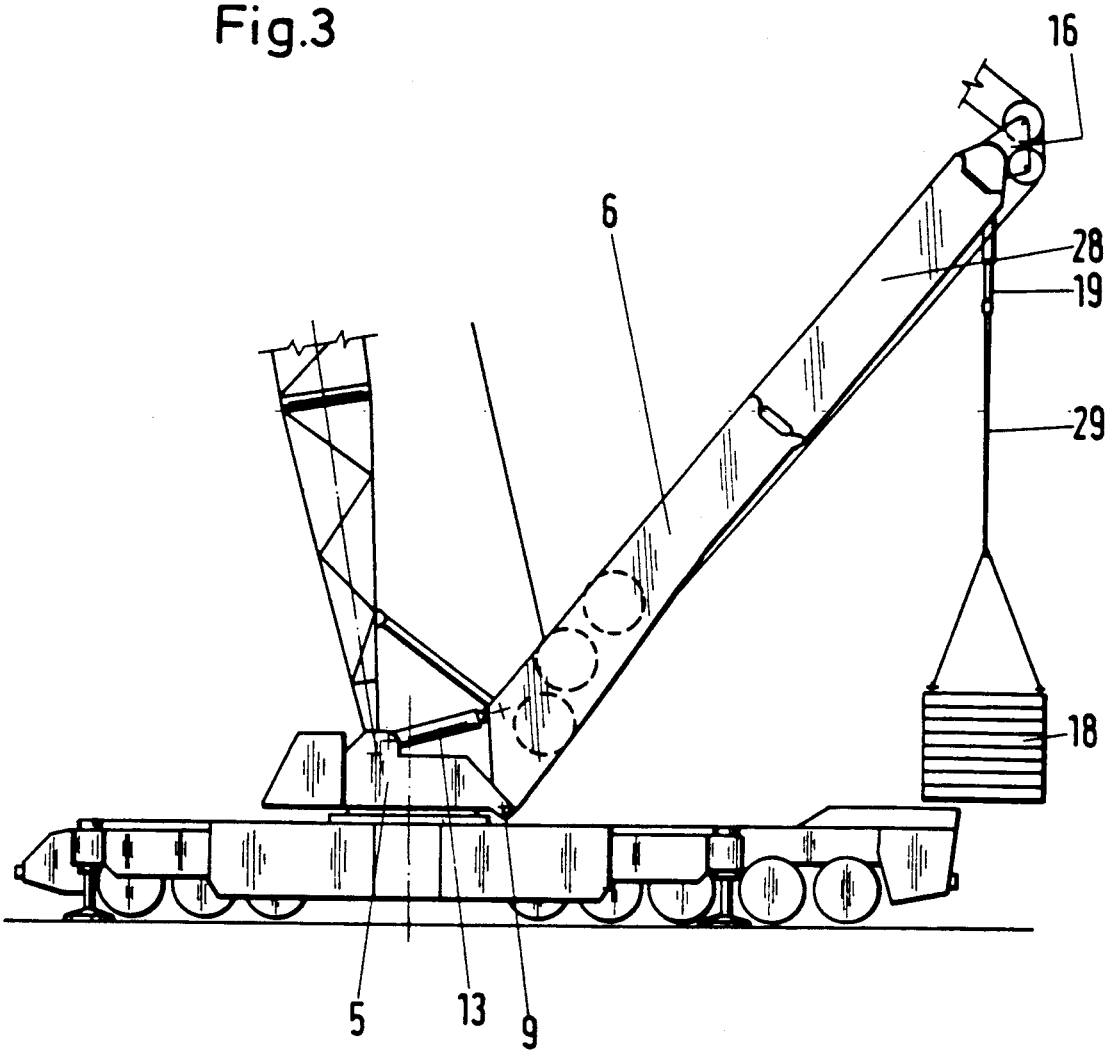
FIGS. 3 to 6 show further embodiments of the superstructure with increased crane supporting capacity, in each case in operating positions.

In FIG. 3 the swing part is lengthened to about twice its length, so that, after the unbolting of the pulley head 16, an intermediate piece 28 is inserted between the pulley head and the rest of the swing part 6 and bolted together in detachable fashion. At the same time, a corresponding extension rod or the like can be attached to the hydraulic ram 19 for attaching the counterweight 18.

Figure 4:
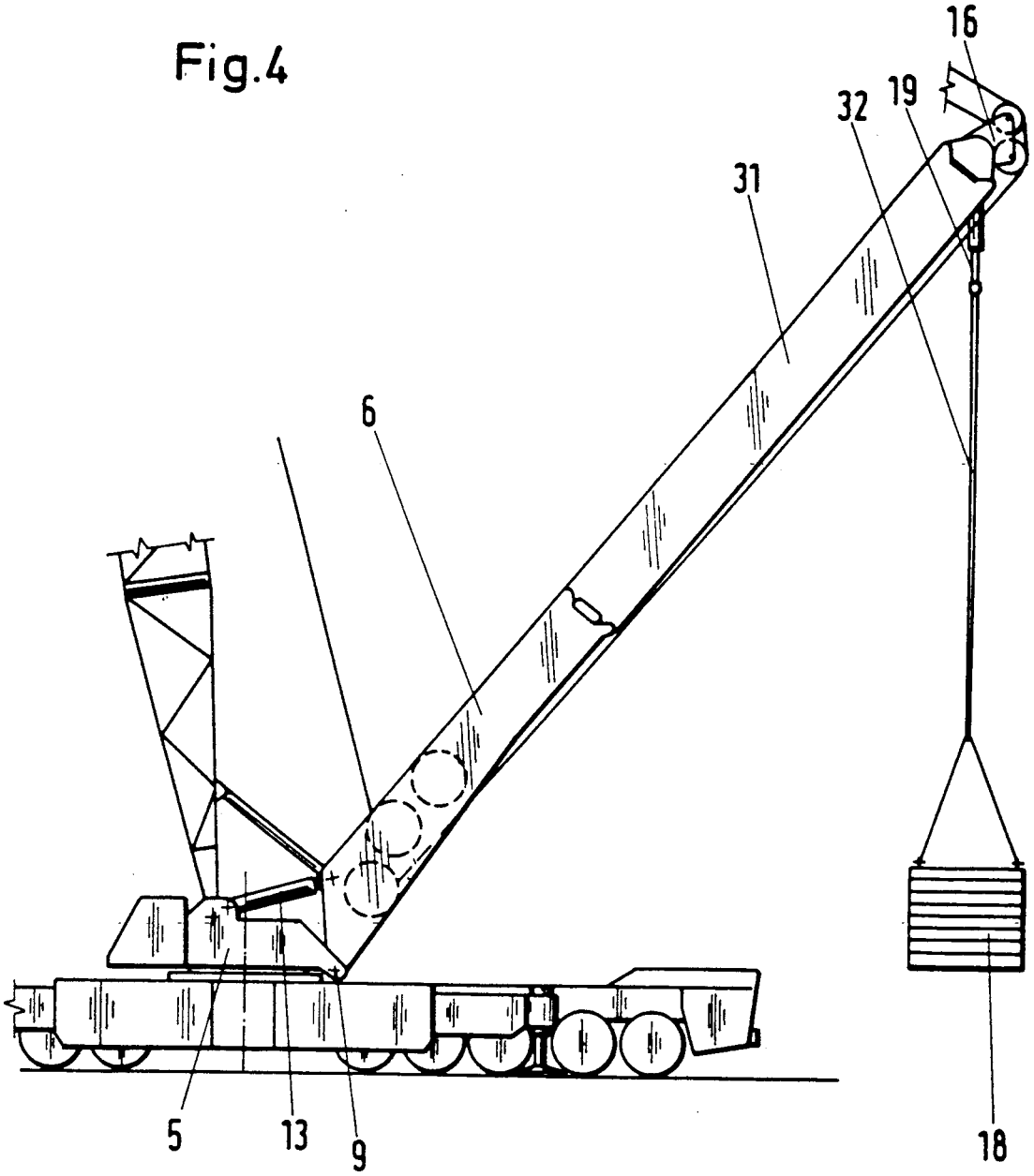
Figure 5:
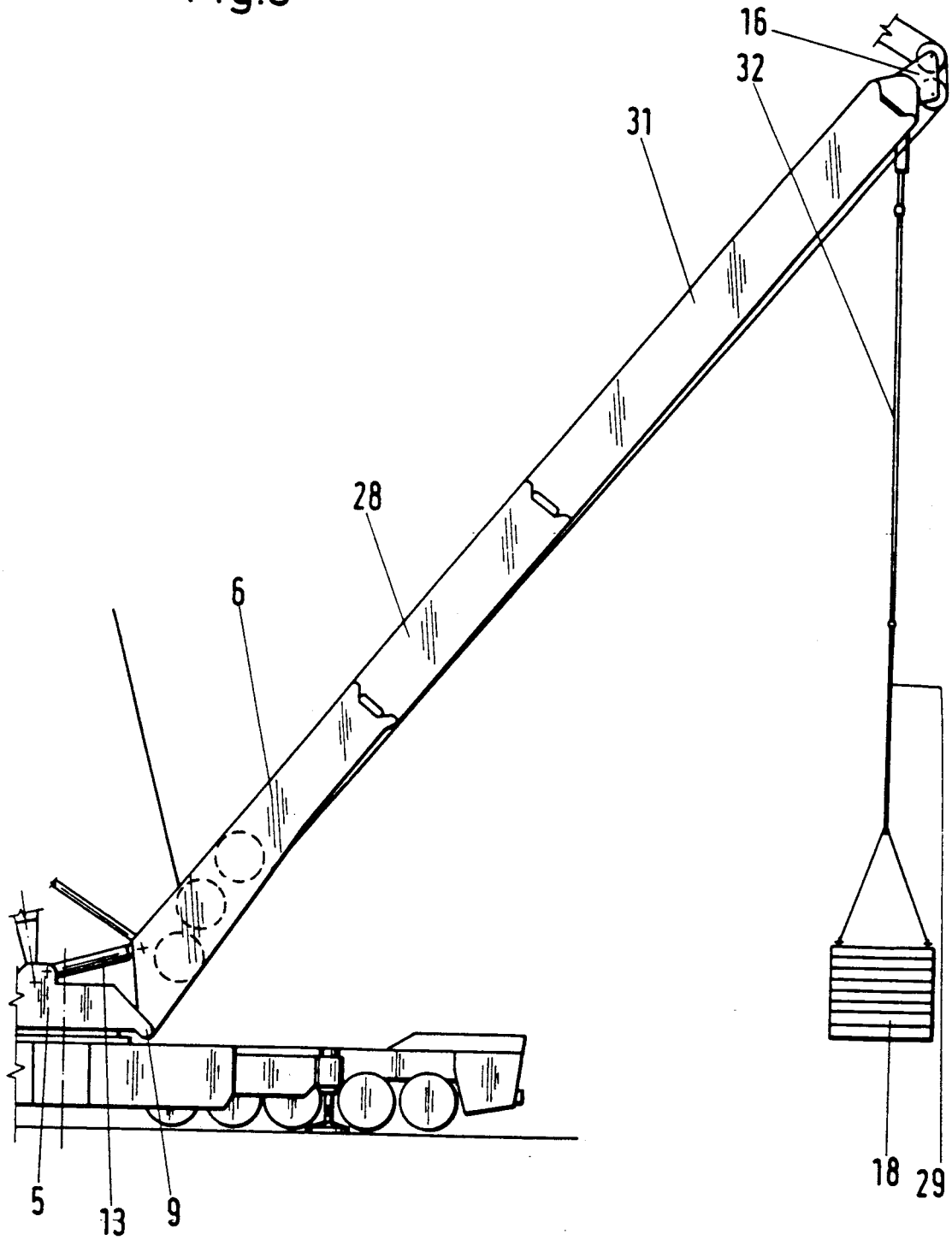

In accordance with FIG. 4, an even greater extension of the swing part is obtained in corresponding manner by attachment of an even longer intermediate piece 31 with, at the same time, a corresponding lengthening of the counterweight attachment via a correspondingly longer rod 32. In FIG. 5 the addition of the two possibilities for lengthening in accordance with FIGS. 3 and 4 are shown, so that in this way a very extensive rearward reach for the counterweight is obtained.

Figure 6:
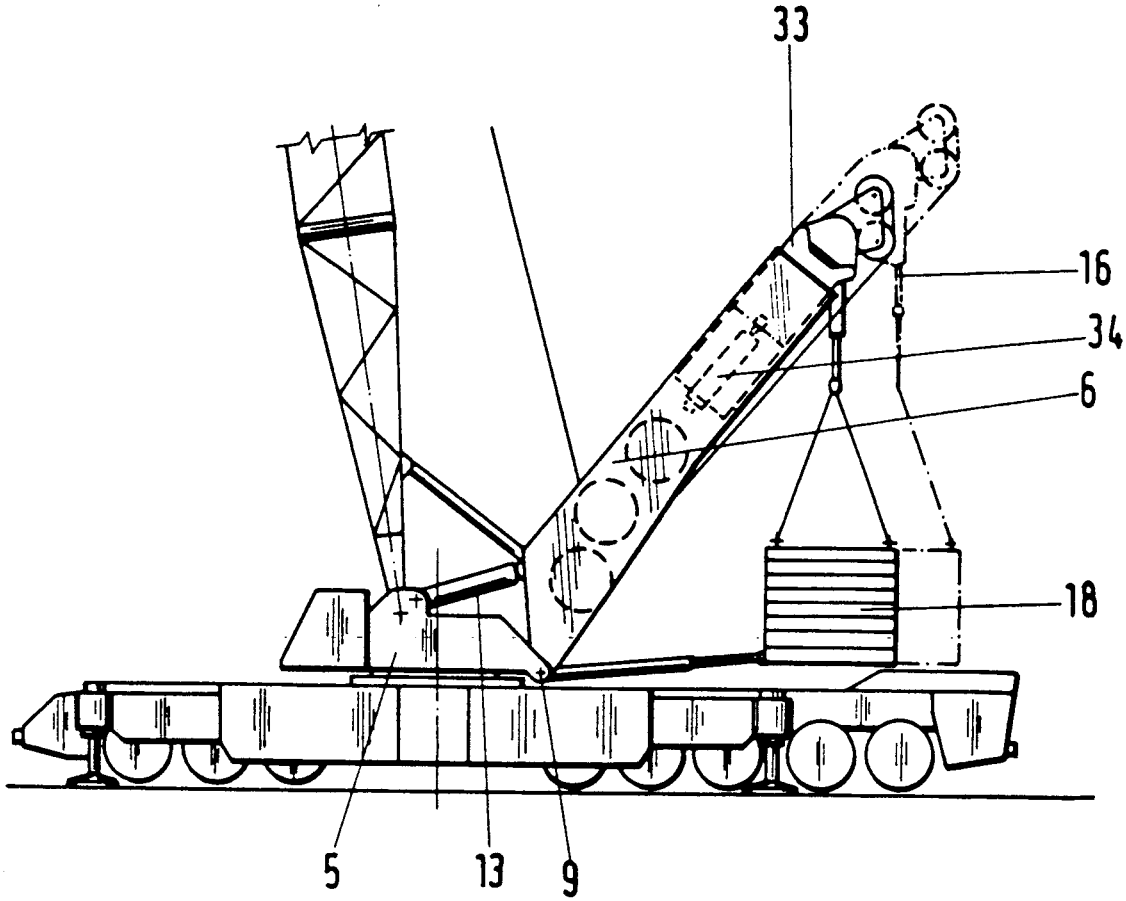

In the embodiment shown in FIG. 6, continuous lengthening of the swing part 6 is effected automatically by a push-out device 34 which extends and retracts the telescopic section 33 which is provided at least over a part of the swing part on the end thereof. It should be mentioned in this connection that the swing part 6 provided with the telescopic section in accordance with FIG. 6 can be provided with intermediate pieces 28 and 31 between the pulley head 16 and the swing part 6, respectively, in the manner shown in FIGS. 3 to 5.

In the embodiments shown in FIGS. 7 to 10, the swing bearing 9 is located laterally at the upper right on the central part 5, while the swing ram or rams 13 are pivoted at the bottom approximately at the height of the revolving joint 3. The lower end 7 of the boom is in this case also supported on the central part 5, this pivot point 11 being approximately at the level of the swing bearing 9.

Figure 7:
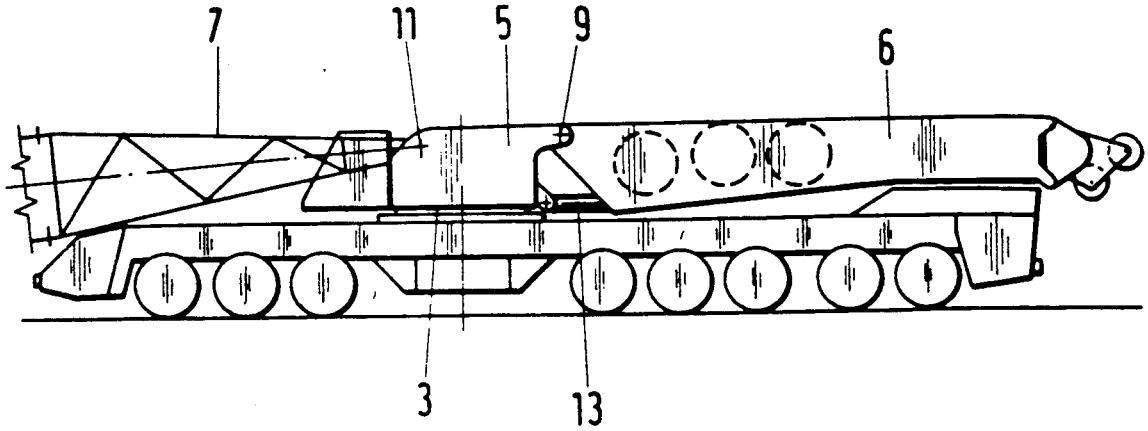
FIGS. 7 to 12 show three further embodiments for the swing connection of the superstructure parts in accordance with the invention, in each case in transport position and operating position.
Figure 8:
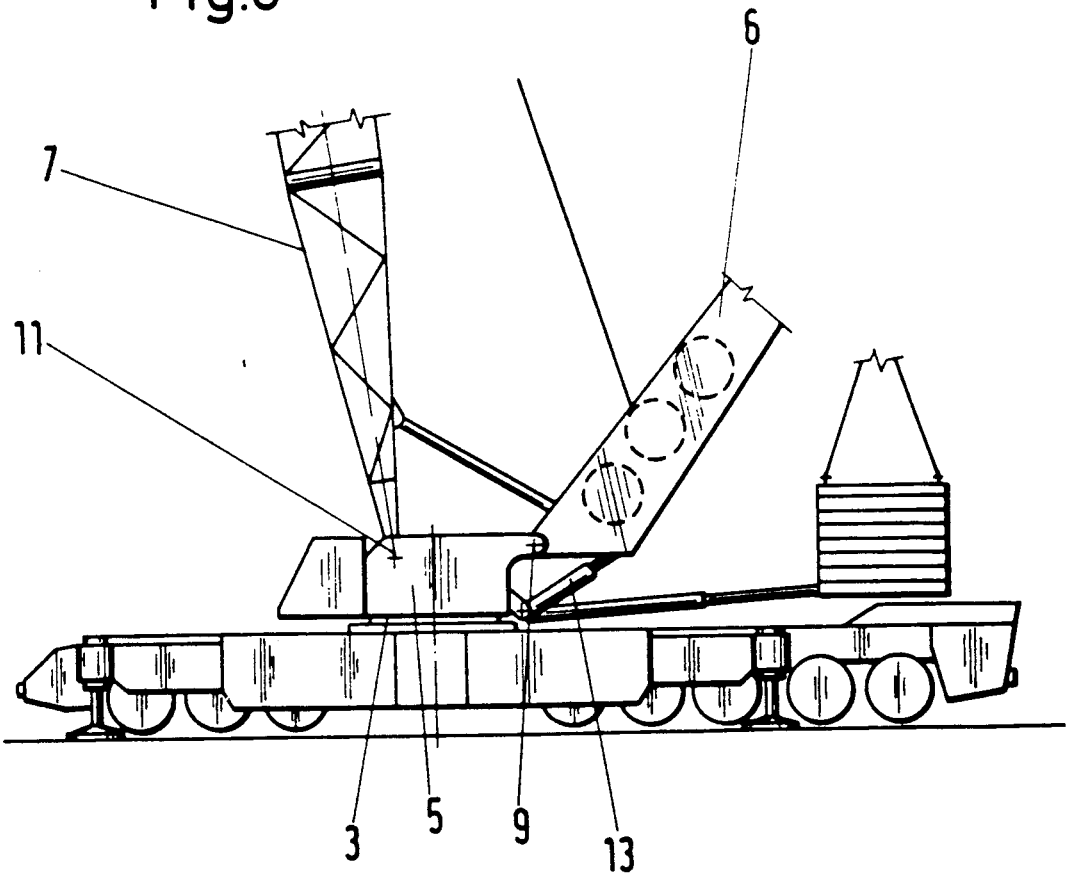
Figure 9:
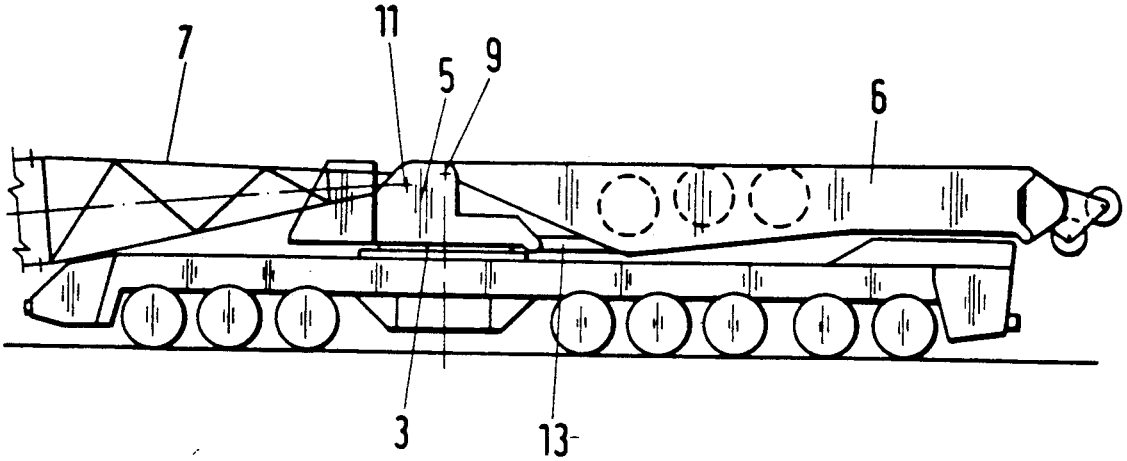
Figure 10:
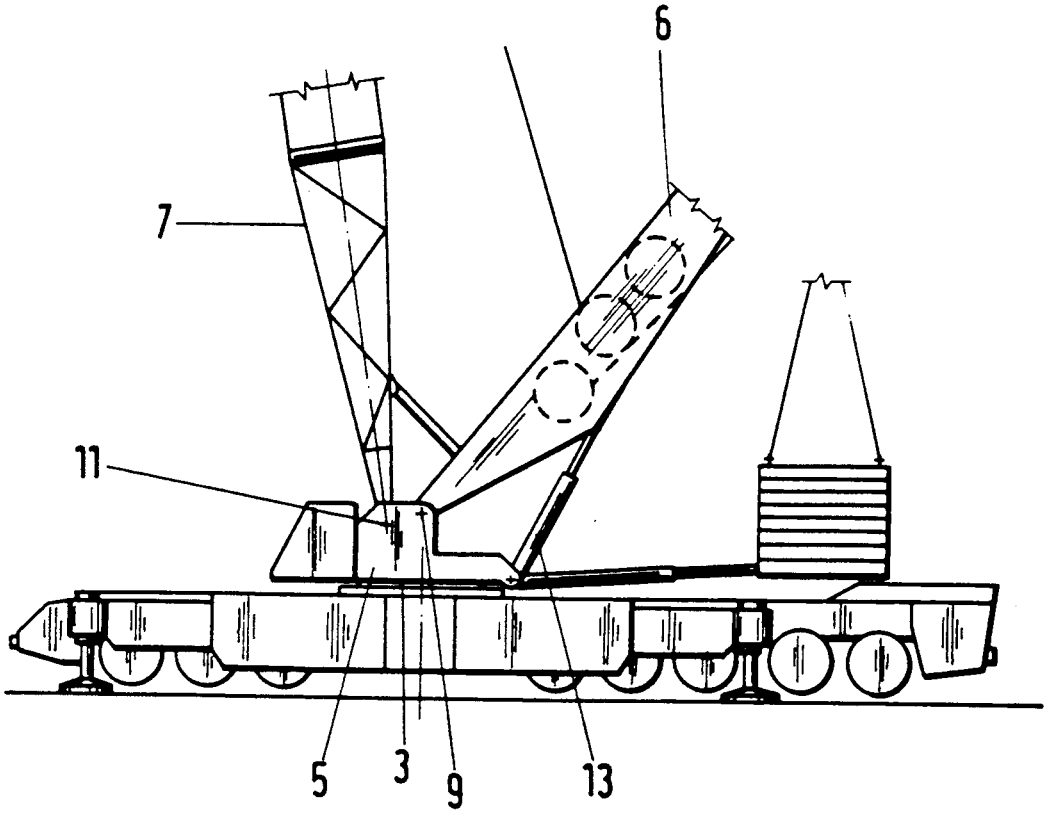

The main difference between the embodiment of FIGS. 7 and 8 and the embodiment of FIGS. 9 and 10 is that in the case of the latter the swing bearing 9 is arranged centrally above the revolving joint 3 at the upper part of the central part 5, which permits a particularly central introduction of the forces supporting the swing part into the revolving joint.

Figure 11:
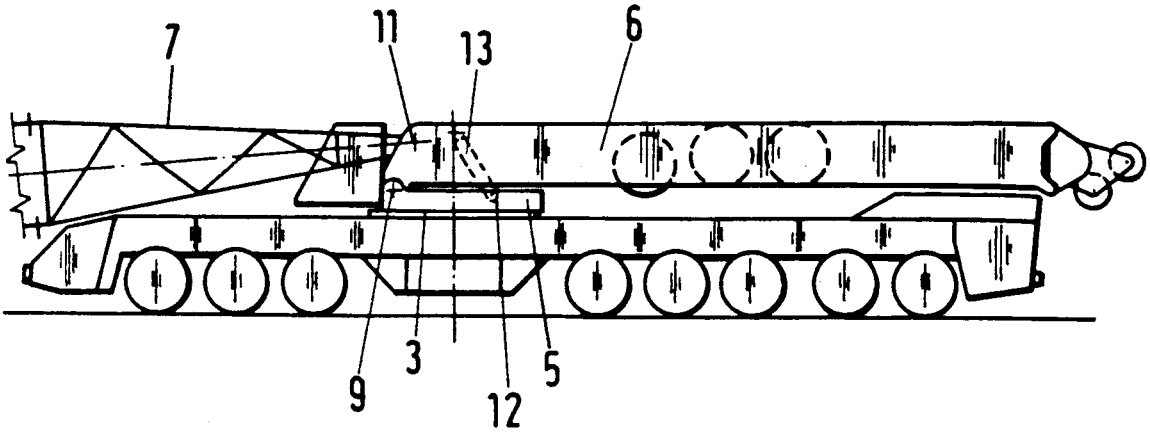
Figure 12:
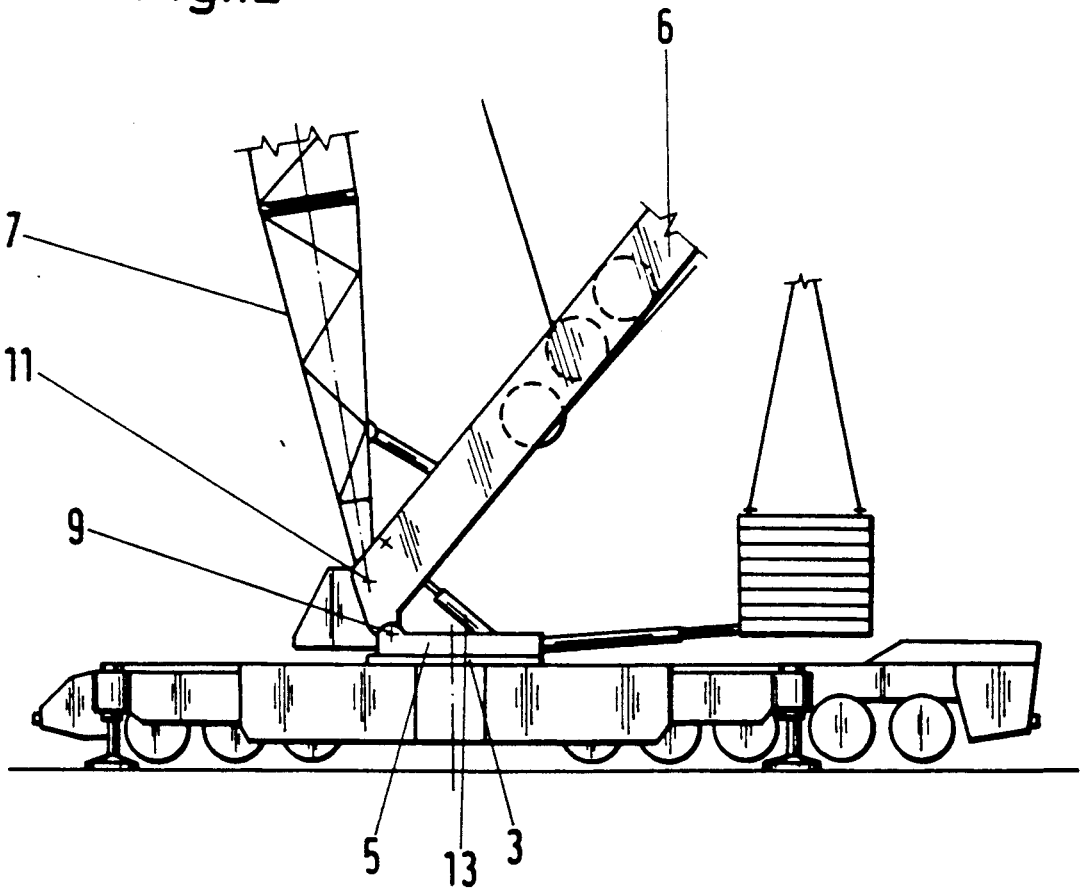

FIGS. 11 and 12 show a particularly economically and structurally clear embodiment of the two-part superstructure of the invention, namely, that the central part 5 is developed as a flat plate resting on the revolving joint 3 and fixed for rotation therewith, and over which, in the transport position (see FIG. 11), the swing part 6 together with its pivot region extends. To this end, the swing bearing 9 is located laterally at the bottom left on the central part 5 and the pivot point for the swing ram 13 also lies on the central part approximately at the same vertical height as the swing bearing 9, the other end of the swing ram 13 pointing in the direction toward the lower end 7 of the main boom and being pivoted on top edge of swing part 6. In this way, as shown in FIG. 12, a particularly favorable static supporting position for the swing ram 13 is obtained in the operating position. The dimensions of the plate-shaped central part can correspond approximately to those of the revolving joint 3. It should be noted in the case of this embodiment also that the pivot point 11 for the lower end 7 of the boom is located in the swing part 6, somewhat laterally above the swing bearing 9.

Figure 13:
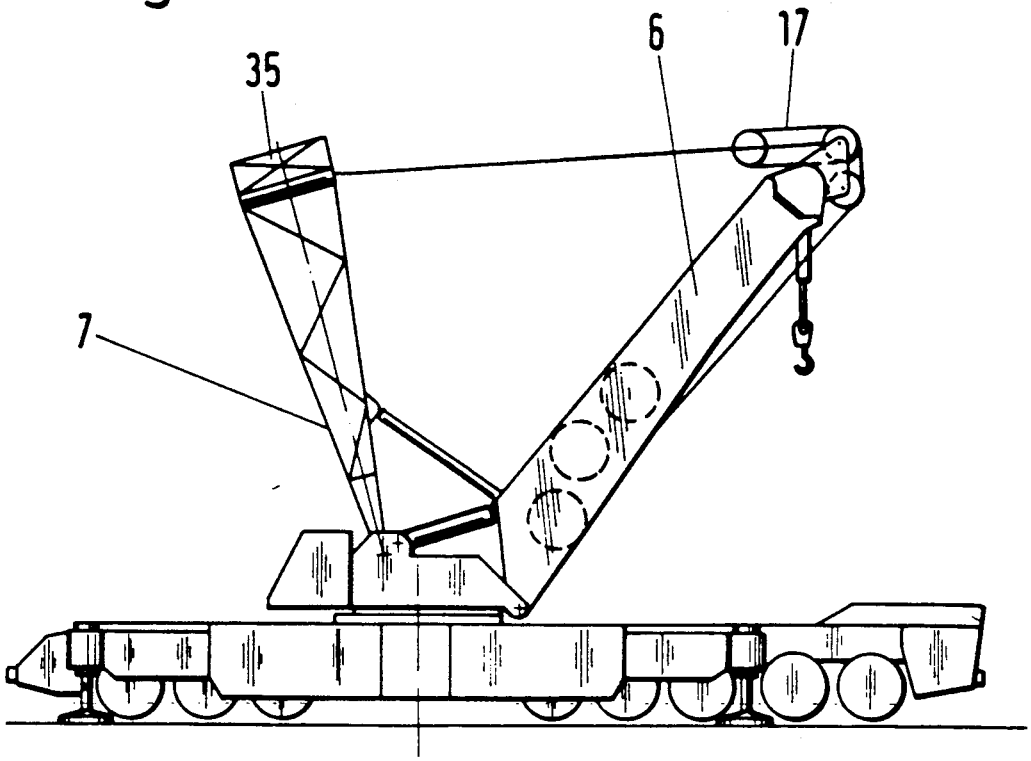
FIG. 13 shows the working position in an embodiment in which the swing part is used as boom.

In the embodiment shown in operating position in FIG. 13, the superstructure shown by way of example in FIGS. 1 and 2 is used, and in this connection the swing part 6 is used as boom, so to speak, of an auxiliary crane, the lower end 7 of the main boom being braced via the retraction mechanism 17 and operating preferably without counterweight 35 so that now the swing part 6 can be used, for instance, as auxiliary crane to pick up its counterweight; this can be carried out with higher supporting capacity also with counterweight or ballast 35 on the lower end 7 of the boom.

In FIGS. 14 to 17 finally, there are shown embodiments having a two-part swing part 6.1, 6.2 in accordance with the invention, the lower, larger part which bears the cable winches 15 as well as the pulley head 16 serving, so to speak, as main girder 6.1 and the smaller, upper part as bracing girder 6.2. In this way, as can be seen, there is obtained a particularly compact, space-saving and, at the same time, enormously stable structure. The swing bearing 9 for the main girder 6.1 in the embodiment in accordance with FIGS. 14 and 15 lies laterally at the bottom right on the central part 5 approximately at the level of the revolving joint 3. The swing ram or rams 13 is/are arranged on the top and connected directly with the free end of the bracing girder, which is pivoted at its other end close to the pulley head 16 on the main girder 6.1. After the swinging of the swing part 6.1, 6.2 by retraction of the swing ram 13, for instance into the position shown in FIG. 15, the swing ram 13 and the bracing girder 6.2 form the bracing for the swing part, a coupling member 36 between the main girder 6.1 and the bracing girder 6.2 preventing the deflection of the bracing upon action of pressure. The lower end 7 of the main boom is supported on the central part close to the pivot point of the swing ram 13 at 11.

Figure 14:
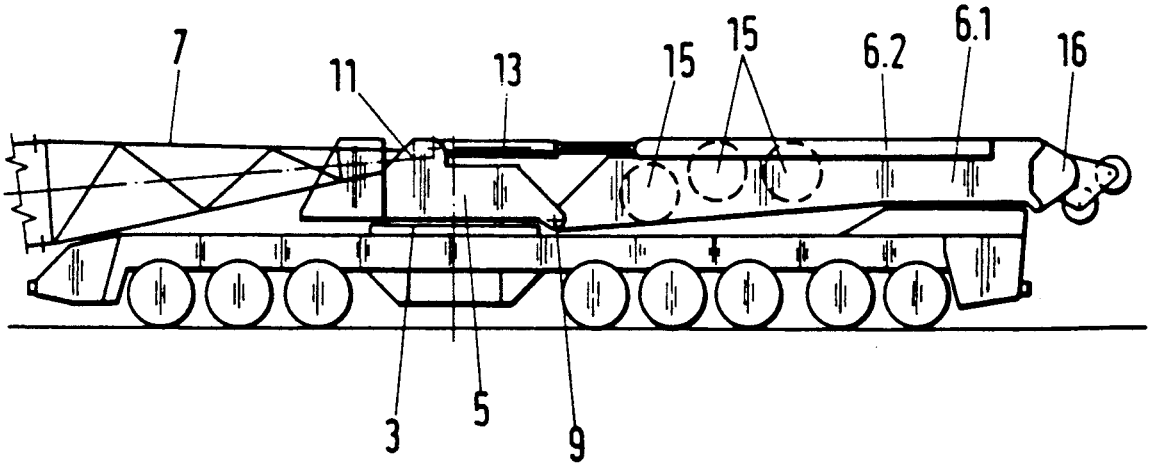
FIG. 14 shows a further embodiment in which the swing part is divided in two, shown in transport position.
Figure 15:
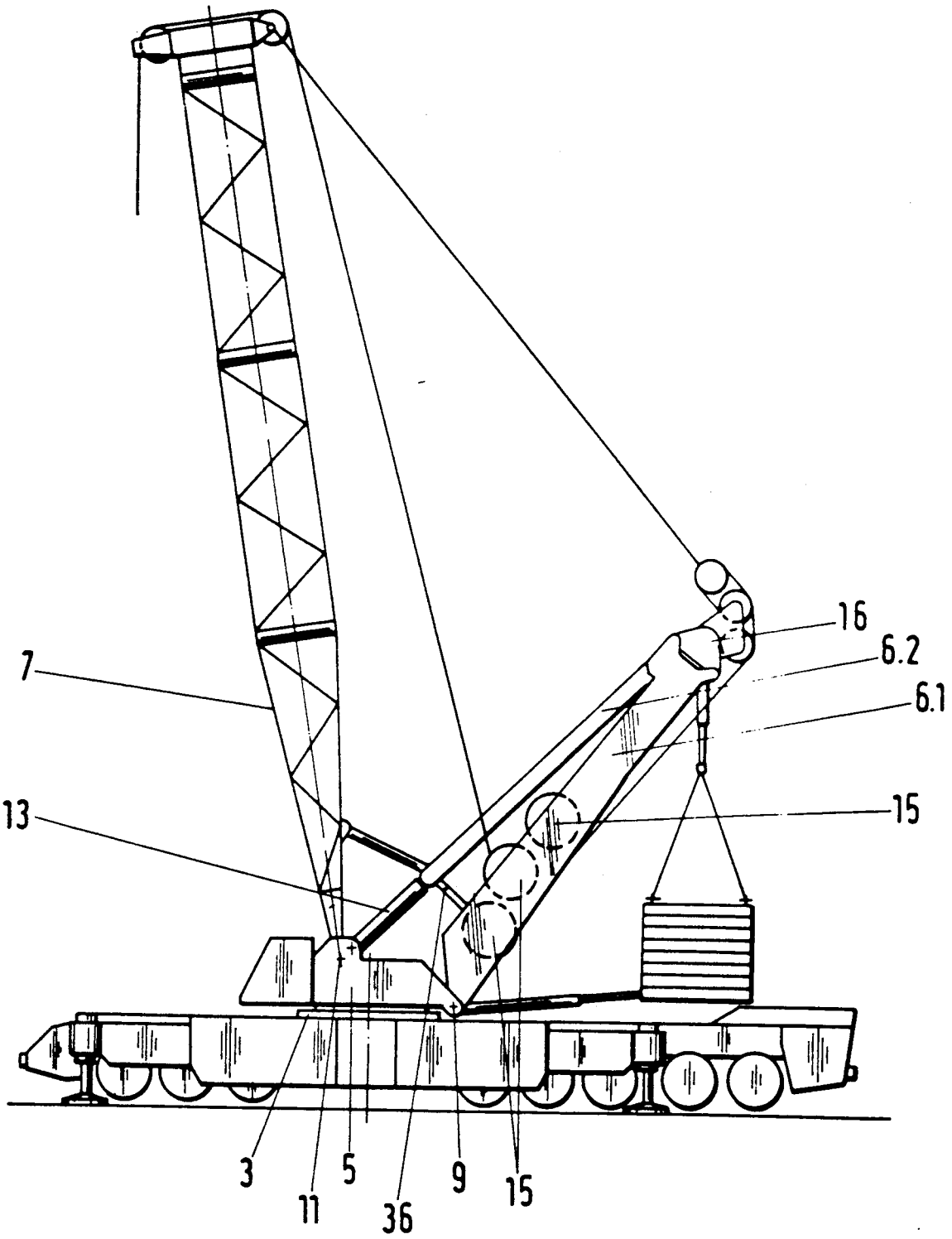
FIG. 15 shows the crane of FIG. 14 in operating position.
Figure 16:
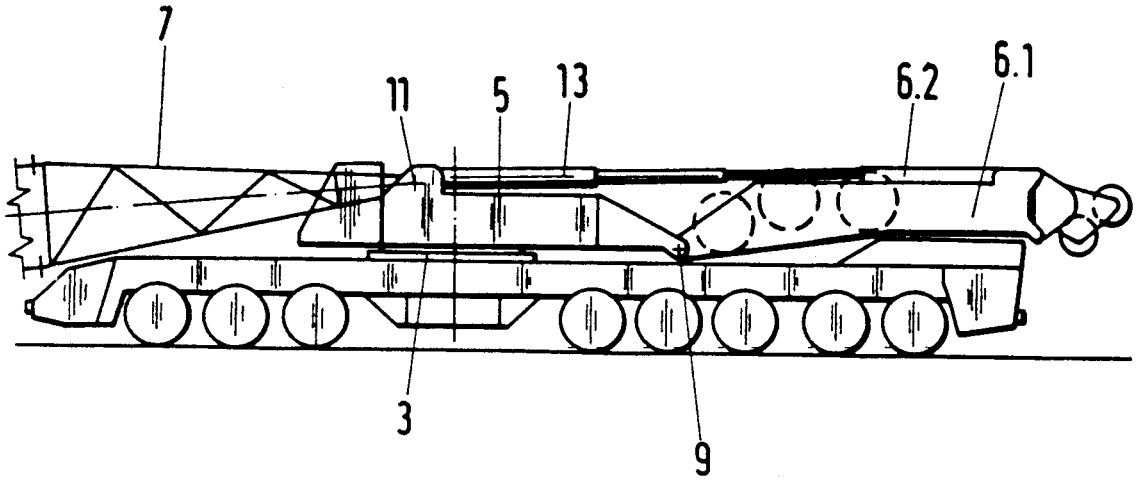
FIG. 16 shows the swing part of FIGS. 14 and 15 with swing bearing lying far outside the region of the revolving joint, as seen in transport position.
Figure 17:
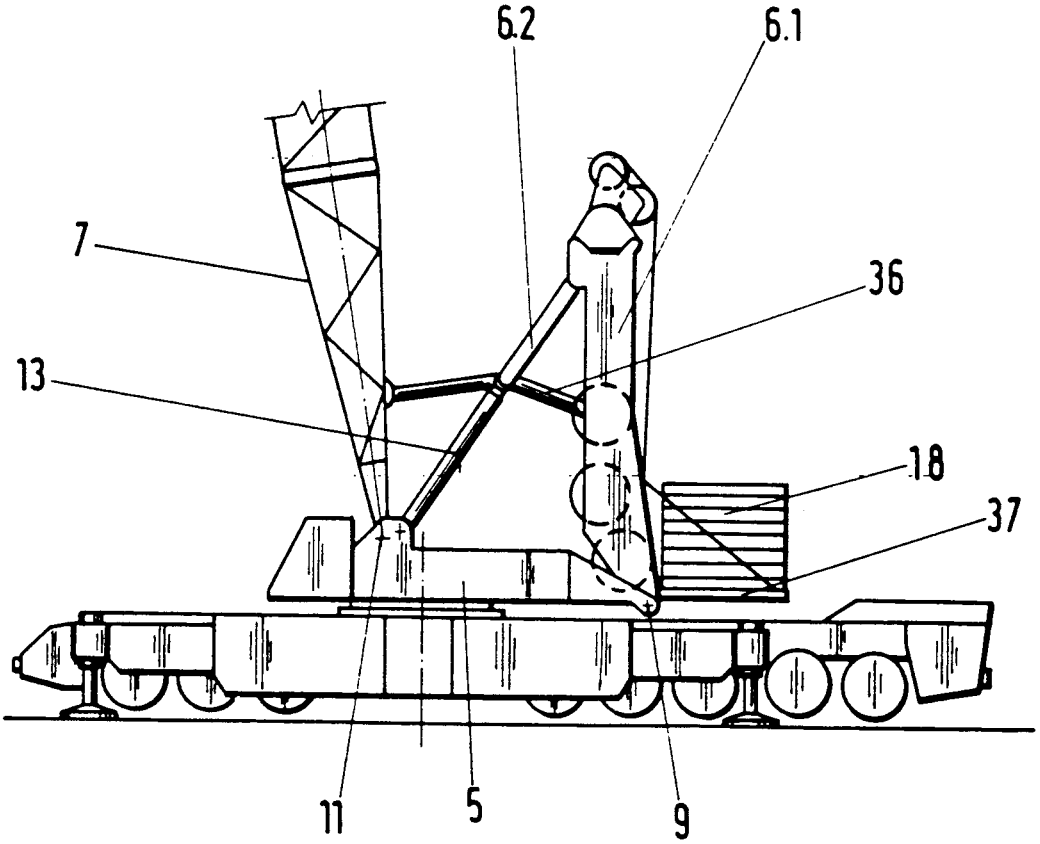
FIG. 17 shows the crane of FIG. 16 in a preferred operating position.

In contrast to the embodiment shown in FIGS. 14 and 15, the swing bearing 9 in the embodiment according to FIGS. 16 and 17 lies far outside the region of the revolving joint 3 on the central part 5 which is extended relatively far in the direction of its longitudinal axis as compared with the other embodiments, so that, in accordance with FIG. 17, in the operating position there results for the swing part, in particular the main girder 6.1, a vertical position which is advantageous for various uses. In particular, the counterweight 18 can be placed on a bracket 37 which is fastened in the region of the swing bearing 9, as a result of which a stable positioning of the counterweight 18 is guaranteed.

Since these as well as further embodiments and modifications thereto are intended to be within the scope of the present invention, the above description should be construed as illustrative and not in a limiting sense, the scope of the invention being defined solely by the following claims.

What is claimed is:

1. A crane comprising:

an undercarriage (1); a revolving joint (3) on said undercarriage (1); a superstructure on said revolving joint (3), said superstructure comprising a central part (5) rotatably mounted on said revolving joint (3); a boom pivotally connected to said central part (5); a swing part (6), and a horizontal swing bearing (9) pivotally mounting said swing part on said central part (5) for movement in a vertical plane on said central part (5); a plurality of winches mounted on said swing part (6); a retraction mechanism (17) mounted at one end of said swing part (6) opposite said swing bearing (9), said retraction mechanism comprising a pulley head (16) and a bracing (25) for said boom; a counterweight(18); means (19) for attaching said counterweight on said end of said swing part (6) for vertical movement relative thereto; at least one hydraulic ram (22) pivotally mounted on said central part (5) and having a free end, said free end acting on said counterweight (18) in a substantially horizontal direction; means (13) operatively connected between said central part (5) and said swing part (6) for swinging said swing part (6) in a vertical plane about said horizontal swing bearing (9); said swing bearing (9) having a horizontal axis extending perpendicular to the longitudinal axis of said superstructure; an operator's cab (8) attached to said central part (5); said swing bearing (9) being located at approximately the height of said revolving joint on said central part (5) at a location farther from said operator's cab (8) than the pivot point of said boom; at least one of said plurality of winches being operatively connected to said bracing for positioning said boom at selected locations about said pivot point and at least another one of said plurality of winches being adapted to be connected to a load cable mounted on said boom for raising and lowering a load.

* * * * *